US012644674B2

(12) United States Patent
Hamamoto et al.

(10) Patent No.: US 12,644,674 B2
(45) Date of Patent: Jun. 2, 2026

(54) THREAT COUNTERMEASURE SYSTEM AND STORAGE MEDIUM

(71) Applicant: MITSUBISHI HEAVY INDUSTRIES, LTD., Tokyo (JP)

(72) Inventors: Koichi Hamamoto, Tokyo (JP); Tomoya Morioka, Tokyo (JP); Tomoya Arisue, Tokyo (JP); Atsushi Ochiai, Tokyo (JP); Shingo Nishikata, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 80 days.

(21) Appl. No.: 18/700,516

(22) PCT Filed: Aug. 22, 2022

(86) PCT No.: PCT/JP2022/031550
§ 371 (c)(1),
(2) Date: Apr. 11, 2024

(87) PCT Pub. No.: WO2023/062942
PCT Pub. Date: Apr. 20, 2023

(65) Prior Publication Data

US 2024/0328757 A1 Oct. 3, 2024

(30) Foreign Application Priority Data

Oct. 15, 2021 (JP) ..... 2021-169316

(51) Int. Cl.
*F41H 11/02* (2006.01)
*F41H 13/00* (2006.01)

(52) U.S. Cl.
CPC ..... *F41H 11/02* (2013.01); *F41H 13/00* (2013.01)

(58) Field of Classification Search
CPC ... F41G 9/002; F41G 7/00; F41G 3/00; F41H 13/00; F41H 13/005; F41H 13/0056; F41H 13/0062; F41H 13/0068
See application file for complete search history.

(56) References Cited

U.S. PATENT DOCUMENTS 5,747,720 A 5/1998 Schnurr et al.
2009/0173788 A1* 7/2009 Moraites ..... G01S 3/784 235/411

(Continued)

FOREIGN PATENT DOCUMENTS

CN 206756000 12/2017
CN 107977987 5/2018

(Continued)

OTHER PUBLICATIONS

International Search Report issued Oct. 4, 2022 in corresponding International Application No. PCT/JP2022/031550.

(Continued)

*Primary Examiner* — J. Woodrow Eldred
(74) *Attorney, Agent, or Firm* — Wenderoth, Lind & Ponack, L.L.P.

(57) ABSTRACT

A threat countermeasure system includes a calculation device and a communication device. The calculation device is configured to determine, based on a threat level of a target, a countermeasure position of attack on the target. The countermeasure position of attack represents either a first countermeasure position to be attacked in order to temporarily impede a function of the target or a second countermeasure position to be attacked in order to stop the function of the target. A first countermeasure period during which the first countermeasure position is attacked in order to at least temporarily impede the function of the target may be shorter than a second countermeasure period during which the (Continued)

second countermeasure position is attacked in order to stop the function of the target.

8 Claims, 5 Drawing Sheets

(56) References Cited

U.S. PATENT DOCUMENTS

| | | | | |
|---|---|---|---|---|
| 2015/0323656 | A1* | 11/2015 | Soletsky | F41H 13/0056 250/492.1 |
| 2017/0059282 | A1 | 3/2017 | Schlosser | |
| 2017/0059692 | A1* | 3/2017 | Laufer | G01S 13/878 |
| 2018/0080747 | A1 | 3/2018 | Nishikata et al. | |
| 2020/0025531 | A1 | 1/2020 | Jung et al. | |
| 2021/0231414 | A1 | 7/2021 | Ochiai et al. | |
| 2022/0163670 | A1 | 5/2022 | Ochiai et al. | |
| 2024/0418482 | A1* | 12/2024 | Hamamoto | F41H 13/0062 |

FOREIGN PATENT DOCUMENTS

| | | |
|---|---|---|
| CN | 112393643 | 2/2021 |
| JP | 2015-62914 | 4/2015 |
| JP | 2017-15311 | 1/2017 |
| JP | 2019-534441 | 11/2019 |
| JP | 2020-118595 | 8/2020 |
| JP | 2021-14958 | 2/2021 |
| JP | 2021-38886 | 3/2021 |

OTHER PUBLICATIONS

Extended European Search Report issued Dec. 13, 2024 in corresponding European Patent Application No. 22880639.4.

Office Action dated Oct. 7, 2025 in Japanese Patent Application No. 2021-169316, with English Translation.

* cited by examiner

THREAT COUNTERMEASURE SYSTEM AND STORAGE MEDIUM

CROSS-REFERENCE TO RELATED APPLICATION

The present application claims the benefit of priority based on Japanese Patent Application No. 2021-169316 filed on Oct. 15, 2021, the entire disclosure of which is incorporated herein by reference.

TECHNICAL FIELD

The present invention relates to a threat countermeasure system and a storage medium.

BACKGROUND ART

In a case where a plurality of flying objects, for example, unmanned aerial vehicles (UAV), are used in attack, it is required to perform a countermeasure against the plurality of flying objects.

Japanese Unexamined Patent Application Publication No. 2015-62914 discloses a system that irradiates a target object with a laser beam. This system performs laser processing of the target object by irradiating a vulnerable part of the target object with the laser beam.

Japanese Unexamined Patent Application Publication No. 2021-14958 discloses a system that performs a countermeasure by irradiating a flying object with a laser beam.

SUMMARY OF INVENTION

However, the inventors have found that even in a case where a part of functions of the flying object is stopped by irradiating the vulnerable portion of the flying object with the laser beam, the flying object may be usable again by recovery of the function after an elapse of time or by complementing the stopped function with alternative means. For example, it is assumed that a function of one rotary wing of a multicopter is stopped because of heat of the laser beam. In this case, the multicopter may be able to fly by rotating another motor of the multicopter.

In view of the above circumstances, one of objects is to efficiently perform a countermeasure against a target by determining a countermeasure position to be attacked in performing the countermeasure against the target in accordance with a threat level of the target. Other objects can be understood from the following disclosure and description of embodiments.

A threat countermeasure system according to one embodiment for achieving the above object includes calculation device and a communication device. The calculation device determines a countermeasure position for performing attack against at least one target based on a threat level of the target. The communication device outputs a countermeasure signal indicating that the attack is to be performed against the countermeasure position of the target. The countermeasure position indicates any one of a first countermeasure position at which a function of the target is temporarily impeded by performing the attack and a second countermeasure position at which the function of the target is stopped by performing the attack.

A non-transitory storage medium according to one embodiment for achieving the above object stores a threat countermeasure program. The threat countermeasure program causes a calculation device to execute determining a countermeasure position for performing attack against at least one target based on a threat level of the target. In addition, the threat countermeasure program causes the calculation device to execute generating countermeasure information indicating that the attack is to be performed against the countermeasure position of the target.

According to the above embodiments, a countermeasure can be efficiently performed against a target.

DESCRIPTION OF EMBODIMENTS

Embodiment 1

Figure 1:
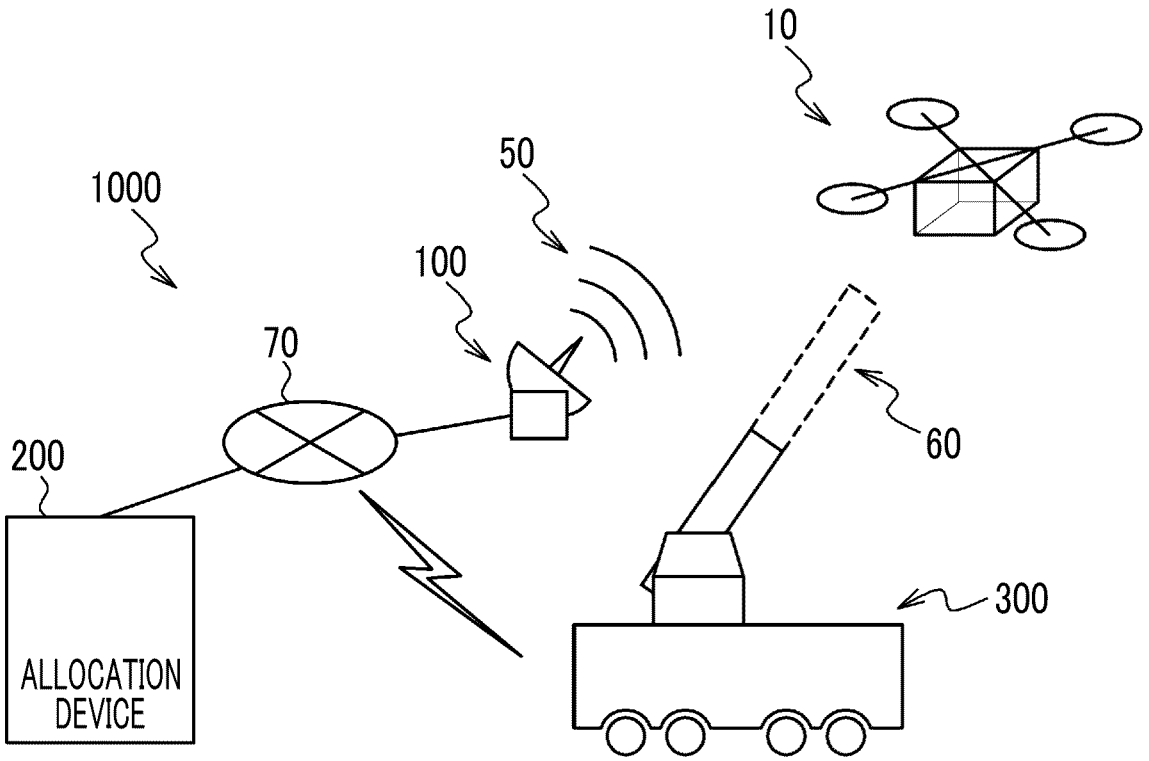
FIG. 1 is a configuration diagram of a threat countermeasure system in one embodiment.

As illustrated in FIG. 1, a threat countermeasure system 1000 according to one embodiment detects a target 10, for example, an unmanned aerial vehicle (UAV), and performs a countermeasure. For example, the threat countermeasure system 1000 includes a detection device 100, an allocation device 200, and a countermeasure device 300. The allocation device 200 is connected to be capable of communicating with the detection device 100, the allocation device 200, and the countermeasure device 300 through a network 70, for example, a wide area network (WAN) or a local area network (LAN).

The detection device 100 detects the target 10 by radiating a detection wave 50, for example, a radar wave or a detection laser beam. The detection device 100 may detect the target 10 by acquiring a signal, for example, a light wave or an electromagnetic wave, radiated from the target 10 without radiating the detection wave 50. The allocation device 200 determines the countermeasure device 300 for performing the countermeasure, for example, attack, against the detected target 10. The countermeasure device 300 performs the countermeasure against the target 10 by, for example, irradiating the target 10 with a laser beam 60. Generally, the countermeasure device 300 irradiates a vulnerable portion of the target 10 with the laser beam 60 in order to neutralize the target 10 in a short time.

Figure 2:
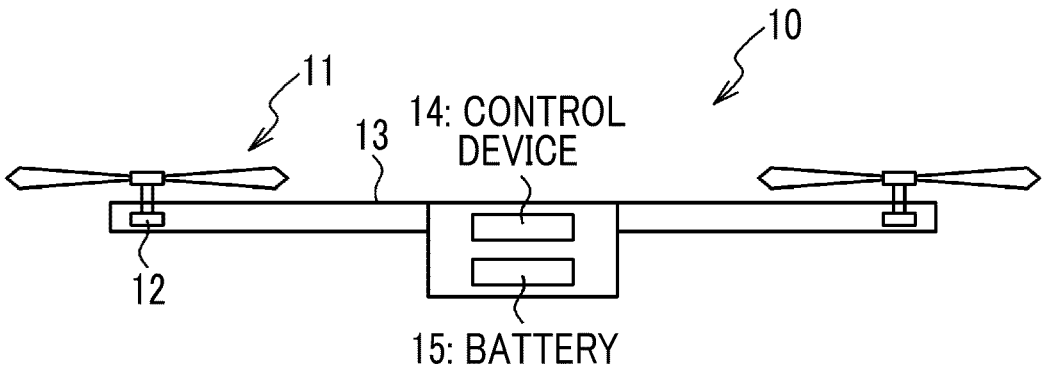
FIG. 2 is a configuration diagram of a target detected in one embodiment.

The target 10 includes a flying object, for example, an unmanned aerial vehicle (UAV). For example, as illustrated in FIG. 2, the target 10 includes a multicopter including a plurality of rotary wings 11. The rotary wings 11 are provided at open ends of arms 13 extending from a center of the target 10 and are connected to motors 12 that rotate the rotary wings 11. The vulnerable portion of the target 10 includes a part, for example, the rotary wings 11, the motors 12, and the arms 13, at which a function of the target 10 is at least temporarily impeded by performing the countermeasure. In addition, the vulnerable portion of the target 10 may include a control device 14 that controls an operation of the target 10, for example, rotation speeds of the rotary wings 11.

Here, even in a case where the function of the vulnerable portion is impeded, the target 10 may fly again in a case where a predetermined period elapses. For example, it is assumed that a function of one motor 12 of the target 10 is stopped because of heat of the laser beam 60 in the target 10. In this case, the target 10 may be able to fly by rotating another motor 12. In addition, it is assumed that an error has occurred in processing of the control device 14 because of a high temperature caused by the laser beam 60. In this case, the control device 14 may be able to normally perform processing in a case where the temperature is decreased after an elapse of time. Accordingly, in a case where the countermeasure device 300 performs the attack against the vulnerable portion of the target 10 as a countermeasure position, the target 10 may fly again in a case where the predetermined period elapses.

Thus, the countermeasure device 300 performs the attack against a position at which the function of the target 10 of a high threat level is completely stopped by performing the attack. For example, the countermeasure device 300 destroys a battery 15 of the target 10 by irradiating the battery 15 with the laser beam 60. In a case where the battery 15 is destroyed, the target 10 cannot fly again and is completely neutralized. Accordingly, in a case where the countermeasure device 300 performs the attack against a position other than the vulnerable portion of the target 10 as the countermeasure position, the countermeasure device 300 can completely neutralize the target 10 by stopping the function of the target 10.

Here, a countermeasure period for at least temporarily impeding the function of the target 10 by performing the attack against the vulnerable portion of the target 10 is generally shorter than a countermeasure period for completely neutralizing the target 10 by performing the attack against a position other than the vulnerable portion of the target 10. Here, the countermeasure period indicates a period from the start of the attack against the target 10 to impeding of the function and, for example, indicates a period from determination of the attack against the target 10 to impeding of the function of the target 10. The countermeasure period includes, for example, a period in which the laser beam 60 is aimed at the target 10 and a period in which the target 10 is irradiated with the laser beam 60.

As described above, the threat countermeasure system 1000 determines the countermeasure position for performing the attack against the target 10 in accordance with a threat level of the target 10, for example, a probability that the target 10 inflicts significant damage on a protection target. Accordingly, the threat countermeasure system 1000 efficiently performs the countermeasure against the target 10 in a short period.

(Configuration of Threat Countermeasure System)

Figure 3:
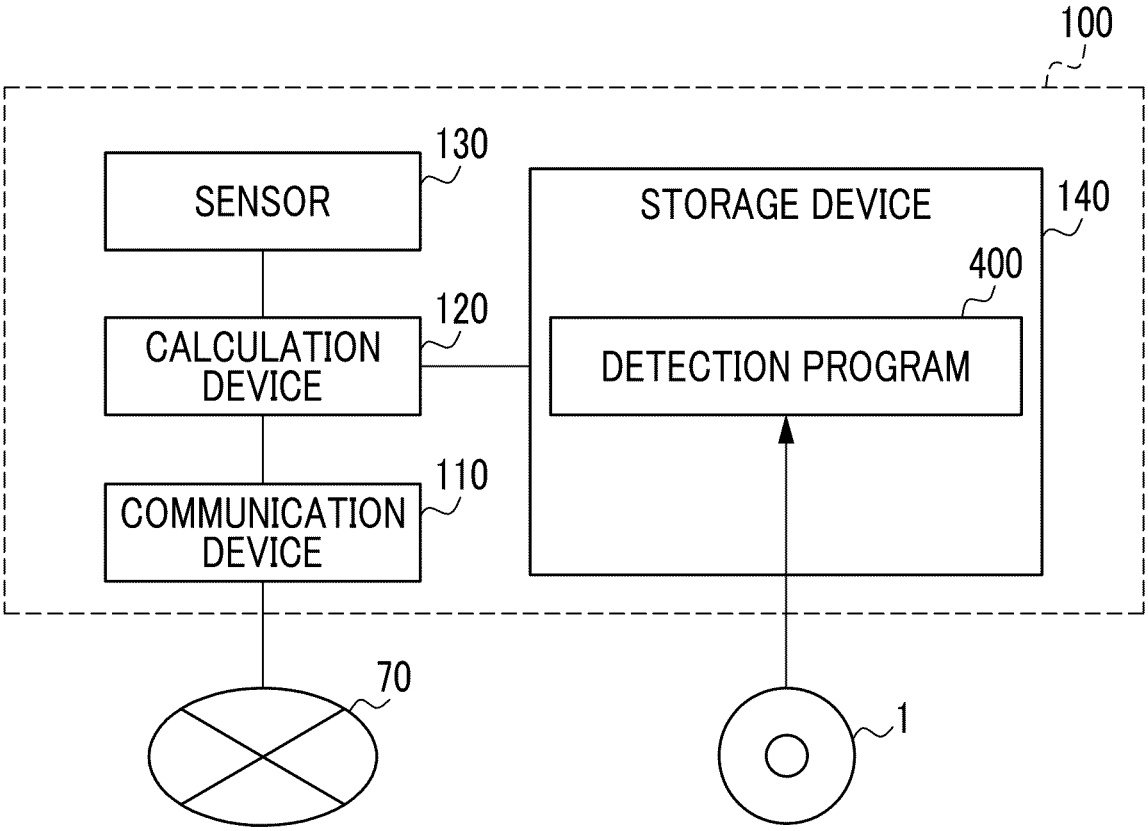
FIG. 3 is a configuration diagram of a detection device in one embodiment.

First, the detection device 100 of the threat countermeasure system 1000 illustrated in FIG. 1 will be described. The detection device 100 detects at least one or more targets 10. For example, as illustrated in FIG. 3, the detection device 100 includes a communication device 110, a calculation device 120, a sensor 130, and a storage device 140.

The communication device 110 is connected to a network 70 and communicates with the detection device 100 and with the allocation device 200. The communication device 110 transfers data received from the allocation device 200 to the calculation device 120. In addition, the communication device 110 transfers a signal generated by the calculation device 120 to the allocation device 200. The communication device 110, for example, includes various interfaces such as a network interface card (NIC) and a USB.

The sensor 130 detects the target 10 and transmits detection information, for example, a position, a speed, a size, and a shape, of the detected target 10 to the calculation device 120. For example, the sensor 130 detects the target 10 by outputting the detection wave 50, for example, an electromagnetic wave or a light wave and receiving a reflective wave reflected by the target 10. In addition, the sensor 130 may detect the target 10 by acquiring a signal, for example, a light wave, an electromagnetic wave, or a sound wave, radiated from the target 10. The sensor 130 may be, for example, a camera that captures the light wave from the target 10.

The storage device 140 stores various types of data, for example, a detection program 400, for detecting the target 10. The storage device 140 is used as a non-transitory tangible storage medium storing the detection program 400. The detection program 400 may be provided as a computer program product recorded on a computer-readable storage medium 1 or may be provided as a computer program product downloadable from a server.

The calculation device 120 performs various types of data processing for detecting the target 10 by reading out the detection program 400 from the storage device 140 and executing the detection program 400. The calculation device 120 transmits the detection information acquired from the sensor 130 to the allocation device 200. For example, the calculation device 120 includes a central processing unit (CPU).

Figure 4:
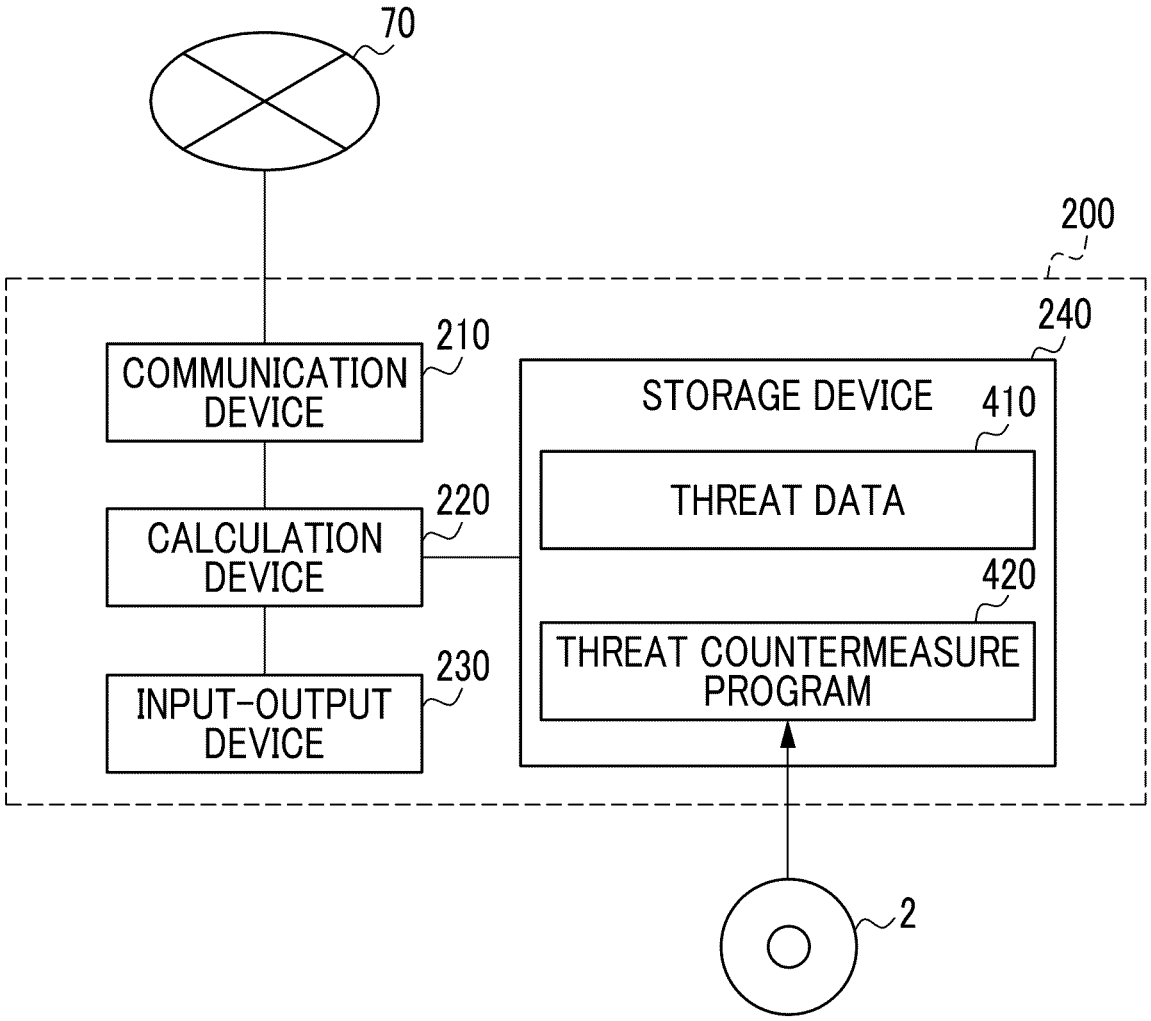
FIG. 4 is a configuration diagram of an allocation device in one embodiment.

Next, a configuration of the allocation device 200 will be described. The allocation device 200 determines the countermeasure position for performing the attack against the detected target 10 based on the detection information acquired from the detection device 100. The determined countermeasure position is transmitted to the countermeasure device 300 which performs the countermeasure against the target 10. For example, as illustrated in FIG. 4, the allocation device 200 includes a communication device 210, a calculation device 220, an input-output device 230, and a storage device 240.

The communication device 210 is connected to the network 70 and communicates with the detection device 100 and with the countermeasure device 300. The communication device 210 transfers data received from the detection device 100 to the calculation device 220. In addition, the communication device 210 transfers a signal generated by the calculation device 220 to the countermeasure device 300. The communication device 210, for example, includes various interfaces such as a network interface card (NIC) and a USB.

Information for executing processing via the calculation device 220 is input into the input-output device 230. In addition, the input-output device 230 outputs a result of the processing executed by the calculation device 220. The input-output device 230 includes various input devices and output devices and, for example, includes a keyboard, a mouse, a microphone, a display, a speaker, and a touch panel.

The storage device 240 stores various types of data, for example, threat data 410 and a threat countermeasure program 420, for determining the countermeasure position for performing the attack against the detected target 10. The storage device 240 is used as a non-transitory tangible storage medium storing the threat countermeasure program 420. The threat countermeasure program 420 may be provided as a computer program product recorded on a computer-readable storage medium 2 or may be provided as a computer program product downloadable from a server. In addition, the threat countermeasure program 420 may be recorded on the storage medium 1.

The threat data 410 stores information related to a plurality of threat targets that may be the target 10. For example, the threat data 410 stores destruction capability, a range, the countermeasure position, and the countermeasure period of the threat target in association with a shape and a size of the threat target. The destruction capability indicates a magnitude of damage inflicted on the protection target by the threat target. For example, the destruction capability indicates a magnitude of damage inflicted on the protection target by an object mounted on the threat target. The destruction capability is increased as the damage inflicted on the protection target is increased. The range indicates a distance in which the threat target can attack the protection target. The countermeasure position includes a first countermeasure position and a second countermeasure position. The first countermeasure position indicates a position of attack at which the function of the target 10 can be at least temporarily impeded in a short time by performing the attack. The first countermeasure position may indicate a position of attack at which a function of a part of the target 10 can be stopped in a short time by performing the attack. The second countermeasure position indicates a position of attack at which the function of the target 10 can be completely stopped by performing the attack. For example, the second countermeasure position indicates a center of gravity or a geometric center of the target 10. The countermeasure period indicates a period from the start of the attack against the threat target to neutralization of the threat target. The threat data 410 stores a first countermeasure period in a case where the first countermeasure position which is a vulnerable portion of the threat target is attacked and a second countermeasure period in a case where the second countermeasure position other than the vulnerable portion is attacked.

The calculation device 220 performs various types of data processing for determining the countermeasure position for performing the attack against the detected target 10 by reading out the threat countermeasure program 420 from the storage device 240 and executing the threat countermeasure program 420. In addition, the calculation device 220 outputs target information indicating the countermeasure position to the countermeasure device 300. For example, the calculation device 220 includes a central processing unit (CPU).

Figure 5:
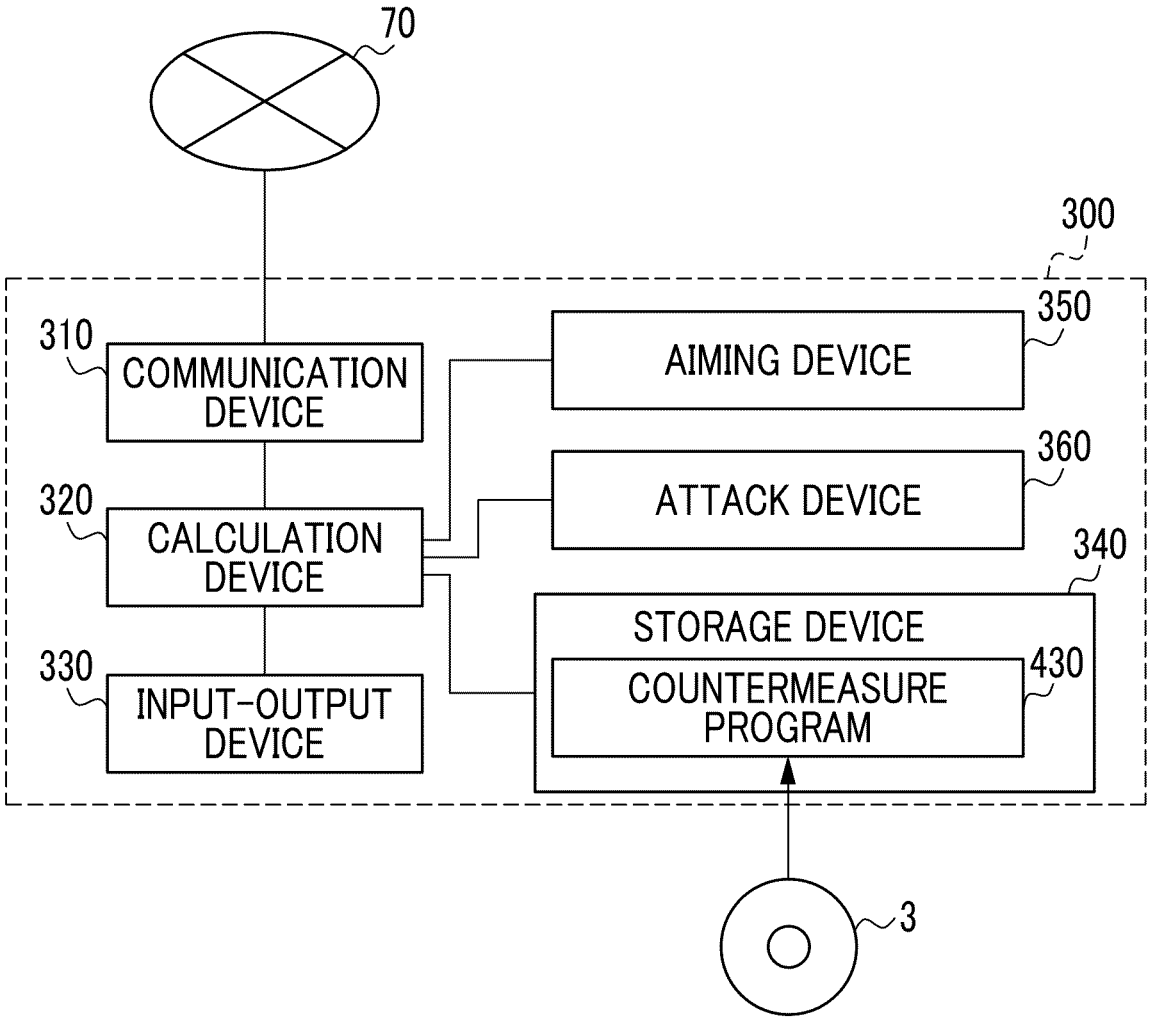
FIG. 5 is a configuration diagram of a countermeasure device in one embodiment.

Next, the countermeasure device 300 will be described. The countermeasure device 300 performs the countermeasure against the target 10. For example, the countermeasure device 300 acquires the target information from the allocation device 200 and attacks the countermeasure position of the target 10. As illustrated in FIG. 5, the countermeasure device 300 includes a communication device 310, a calculation device 320, an input-output device 330, a storage device 340, an aiming device 350, and an attack device 360. The countermeasure device 300 may be able to move by including a traveling device, for example, a wheel or a continuous track, or may be fixed on the ground.

The communication device 310 is connected to the network 70 and communicates with the allocation device 200. The communication device 310 transfers data received from the allocation device 200 to the calculation device 320. In addition, the communication device 310 transfers a signal generated by the calculation device 320 to the allocation device 200. The communication device 310, for example, includes various interfaces such as a network interface card (NIC) and a USB.

Information for executing processing via the calculation device 320 is input into the input-output device 330. In addition, the input-output device 330 outputs a result of the processing executed by the calculation device 320. The input-output device 330 includes various input devices and output devices and, for example, includes a keyboard, a mouse, a microphone, a display, a speaker, and a touch panel. The input-output device 330 may be omitted.

The storage device 340 stores various types of data, for example, a countermeasure program 430, for performing the countermeasure against the target 10. The storage device 340 is used as a non-transitory tangible storage medium storing the countermeasure program 430. The countermeasure program 430 may be provided as a computer program product recorded on a computer-readable storage medium 3 or may be provided as a computer program product downloadable from a server. The countermeasure program 430 may be recorded on the storage medium 1 or on the storage medium 2.

The calculation device 320 performs various types of data processing for performing the countermeasure against the target 10 by reading out the countermeasure program 430 from the storage device 340 and executing the countermeasure program 430. For example, the calculation device 320 includes a central processing unit (CPU).

The aiming device 350 detects the countermeasure position for performing the attack against the target 10. For example, the aiming device 350 detects the countermeasure position of the target 10 by receiving the light wave from the target 10. Information indicating the detected countermeasure position of the target 10 is output to the calculation device 320.

The attack device 360 performs the countermeasure against the target 10 based on an instruction from the calculation device 320. For example, in the case of performing the countermeasure against the target 10 by irradiating the target 10 with the laser beam 60, the attack device 360 acquires an irradiation position from the calculation device 320 and irradiates the acquired irradiation position with the laser beam 60.

(Operation of Threat Countermeasure System)

In a case where the calculation device 120 of the detection device 100 is started up, the calculation device 120 starts detecting the target 10 in its surrounding region by reading out and executing the detection program 400. For example, the calculation device 120 starts searching for one or more targets 10 by starting up the sensor 130. In a case where the sensor 130 detects the target 10, the calculation device 120 acquires the detection information related to the detected target 10 from the sensor 130 and transmits the detection information to the allocation device 200. For example, the detection information includes information such as a position, an altitude, a traveling direction, a speed, acceleration, a size, and a shape of the target 10. The calculation device 120 may read out and execute the detection program 400 in a case where the calculation device 120 receives an instruction signal indicating the start of detection from another system.

Figure 6:
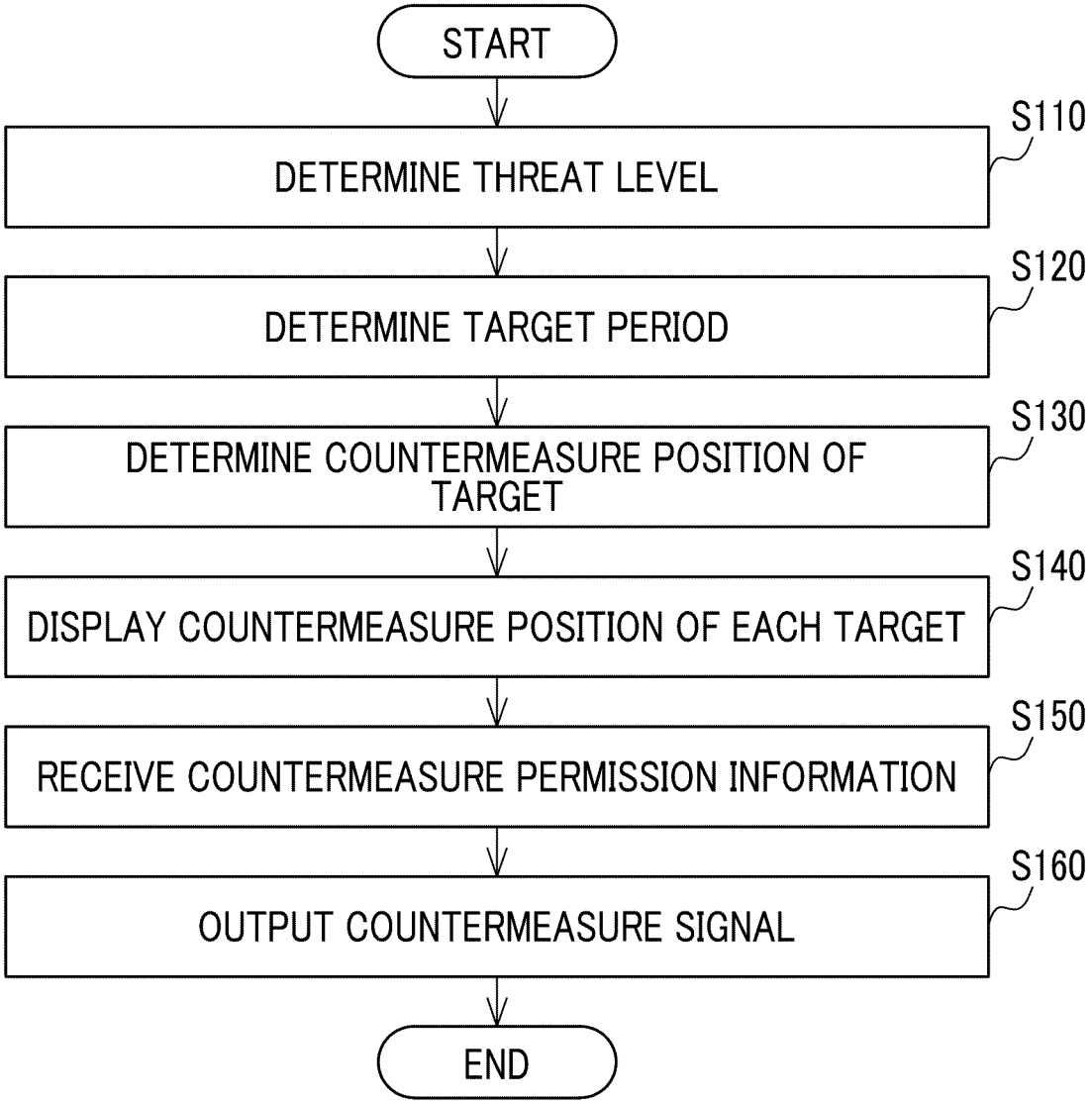
FIG. 6 is a flowchart illustrating processing performed by the allocation device in one embodiment.

The calculation device 220 of the allocation device 200 executes the processing illustrated in FIG. 6 by reading out and executing the threat countermeasure program 420 in a case where the calculation device 220 receives the detection information from the detection device 100. In step S110, the calculation device 220 determines the threat level of each detected target 10 based on the detection information. For example, the threat level is determined based on a state of the target 10, for example, a magnitude of the damage inflicted on the protection target by the target 10 and shortness of a period required until the damage is inflicted, and indicates a priority level of the target 10 to be subjected to the countermeasure. For example, the calculation device 220 determines the threat level of the target 10 based on a distance from the position of the target 10 to the protection target. The threat level is determined to be increased as the distance from the position of the target 10 to the protection target is decreased. In addition, the calculation device 220 may determine the threat level of the target 10 based on the traveling direction of the target 10. For example, the threat level is determined to be increased as an angle between the traveling direction of the target 10 and a direction from the target 10 to the protection target is decreased. In addition, the calculation device 220 may determine the threat level of the target 10 based on the position, the traveling direction, and the speed of the target 10. For example, the calculation device 220 calculates a time from a current time point to a time point at which the target 10 reaches the protection target and determines the threat level to be increased as the calculated time is decreased.

In addition, the calculation device 220 may determine the threat level of the target 10 based on the detection information and on the threat data 410. For example, the calculation device 220 determines the threat target similar in size and shape to the detected target 10 from the threat data 410 and determines the destruction capability stored in association with the threat target as the threat level of the target 10. In addition, the calculation device 220 may determine the threat level of the target 10 based on a time from the current time point to a time point at which the target 10 reaches a position at which the protection target can be attacked. For example, the calculation device 220 determines the threat target similar in size and shape to the detected target 10 from the threat data 410 and acquires the range of the threat target. The calculation device 220 calculates a time in which the target 10 reaches a position at which the distance from the target 10 to the protection target is less than or equal to the range, based on the position, the traveling direction, and the speed of the target 10. The threat level is determined to be increased as the calculated time is decreased.

In addition, the calculation device 220 may determine a plurality of threat level coefficients based on the detection information and on the threat data 410 and calculate the threat level of the target 10 using the determined plurality of threat level coefficients. For example, one threat level coefficient is determined based on the distance from the position of the target 10 to the protection target. One threat level coefficient is determined based on the traveling direction of the target 10. In addition, one threat level coefficient may be determined based on the position, the traveling direction, and the speed of the target 10. In addition, the calculation device 220 determines the threat target similar in size and shape to the detected target 10 from the threat data 410 and determines destruction capability stored in association with the threat target as the threat level coefficient of the target 10. The calculation device 220 calculates the threat level of the target 10 using, for example, a function that has the determined plurality of threat level coefficients as arguments.

In step S120, the calculation device 220 determines a target period indicating a time in which the countermeasure is to be performed against each target 10. For example, the calculation device 220 determines a time from the current time point to the time point at which the target 10 reaches the protection target as the target period. In addition, the target period may be a time from the current time point to the time point at which the target 10 reaches the position at which the protection target can be attacked.

In step S130, the calculation device 220 determines the countermeasure position of the target 10 based on the target period for each target 10. The countermeasure position indicates a position on the target 10 to be attacked by the countermeasure device 300. The calculation device 220 determines the countermeasure position of each target 10 such that the countermeasure is to be performed against all of the targets 10 within each target period. For example, the calculation device 220 acquires the countermeasure period from the start of the attack against the target 10 to neutralization of the target 10 from the threat data 410 for each target 10. The calculation device 220 determines the countermeasure position for performing the attack against each target 10 so that the countermeasure can be performed against all of the detected targets 10 within the corresponding target periods. For example, the calculation device 220 determines the countermeasure position of each target 10 such that the countermeasure period for one target 10 does not overlap with the countermeasure period for another target 10.

For example, the calculation device 220 determines the second countermeasure position of each target 10 as the countermeasure position of each target 10 in a case where the second countermeasure period for performing the attack against the second countermeasure position can be allocated for all of the targets 10 within each target period. For example, the calculation device 220 acquires the shortest target period among the target periods of each target 10. The calculation device 220 compares the acquired shortest target period with a total period of the second countermeasure periods in a case where the attack is performed against the second countermeasure position other than the vulnerable portion for each target 10. In a case where the shortest target period is greater than or equal to the total period of the second countermeasure periods, the calculation device 220 determines the second countermeasure position other than the vulnerable portion at which the function of the target 10 is completely stopped by performing the attack as the countermeasure position for all of the targets 10. Even in a case where the shortest target period is shorter than the total period of the second countermeasure periods, the calculation device 220 may determine the second countermeasure position of each target 10 as the countermeasure position of each target 10 in a case where the second countermeasure period can be allocated within each target period. For example, in a case where the total period of the second countermeasure periods except for one target 10 is less than or equal to the shortest target period and the target period of the one target 10 is greater than or equal to a total period of the shortest target period and the second countermeasure periods, the calculation device 220 may determine the second countermeasure position as the countermeasure position for each target 10.

For example, in a case where the second countermeasure period cannot be allocated for at least a part of the targets 10 within each target period, the calculation device 220 determines the first countermeasure position as the countermeasure position for the part of the targets 10 and determines the second countermeasure position as the countermeasure position for the other targets 10. For example, in a case where the shortest target period is shorter than the total period of the second countermeasure periods, the calculation device 220 changes the countermeasure position of the target 10 having a low threat level to the first countermeasure position at which the function of the target 10 is at least temporarily impeded by performing the attack, so that the countermeasure can be performed against all of the targets 10 within the target periods. For example, the calculation device 220 determines the first countermeasure position which is the vulnerable portion as the countermeasure position for a first target group that is a part of the plurality of targets 10 and determines the second countermeasure position other than the vulnerable portion as the countermeasure position for a second target group not included in the first target group among the plurality of targets 10. For example, the first target group and the second target group may be determined such that the threat level of the target 10 included in the first target group is lower than the threat level of the target 10 included in the second target group. Accordingly, the calculation device 220 determines the countermeasure position of each target 10.

In step S140, the calculation device 220 displays the countermeasure position of each target 10 on the input-output device 230. For example, the calculation device 220 displays information indicating whether to perform the countermeasure in a short time by attacking the vulnerable portion or completely neutralize the target 10 by attacking a position other than the vulnerable portion, for each target 10.

In step S150, the calculation device 220 receives countermeasure permission information indicating whether or not to permit the countermeasure against the determined countermeasure position. For example, in a case where information indicating that the countermeasure against the countermeasure position of the target 10 is permitted is input into the input-output device 230, the countermeasure permission information includes information indicating that the countermeasure against the determined countermeasure position is permitted for the corresponding target 10. In addition, in a case where information indicating that the countermeasure position is changed is input into the input-output device 230, the countermeasure permission information includes information indicating that the countermeasure position of the corresponding target 10 is changed. In addition, in a case where information indicating that the countermeasure against the target 10 is stopped is input into the input-output device 230, the countermeasure permission information includes information indicating that the countermeasure against the corresponding target 10 is stopped. The countermeasure permission information includes information for one or more targets 10 for which whether or not to permit the countermeasure is input.

In step S160, the calculation device 220 outputs a countermeasure signal indicating that the attack is to be performed against the countermeasure position to the countermeasure device 300 based on the countermeasure permission information. For example, the calculation device 220 generates countermeasure information indicating the target 10 and the countermeasure position of the target 10 based on the countermeasure permission information. The generated countermeasure information is converted into the countermeasure signal and is output to the countermeasure device 300. For example, in a case where the countermeasure permission information indicates that the countermeasure against the determined countermeasure position is permitted for the target 10, the countermeasure signal includes a signal for providing an instruction to perform the attack against the determined countermeasure position for the corresponding target 10.

In a case where the countermeasure permission information indicates that the countermeasure position of the target 10 is changed, the calculation device 220 changes the countermeasure position of the target 10 and outputs the countermeasure signal indicating that the attack is to be performed against the changed countermeasure position for the corresponding target 10. For example, in a case where the determined countermeasure position indicates the vulnerable portion, the calculation device 220 outputs the countermeasure signal for a position other than the vulnerable portion as the countermeasure position for stopping the function of the target 10. In addition, in a case where the determined countermeasure position indicates a position other than the vulnerable portion for stopping the function of the target 10, the calculation device 220 outputs the countermeasure signal for the vulnerable portion of the target 10 as the countermeasure position. In a case where the countermeasure device 300 performs the countermeasure against the plurality of targets 10, the countermeasure signal includes a signal indicating an order of the targets 10 to be subjected to the countermeasure.

In a case where the calculation device 320 of the countermeasure device 300 illustrated in FIG. 5 receives the countermeasure signal from the calculation device 220 of the allocation device 200, the calculation device 320 performs the attack against the countermeasure position of the target 10. For example, in a case where the calculation device 320 receives the countermeasure signal, the calculation device 320 performs the countermeasure against the target 10 by reading out the countermeasure program 430 from the storage device 340 and executing the countermeasure program 430. For example, the calculation device 320 acquires the target information, for example, the position and the countermeasure position of the target 10, that is indicated in the countermeasure signal and that is related to the target 10 to be subjected to the countermeasure first. Next, the calculation device 320 acquires a relative position from the attack device 360 corresponding to the countermeasure position of the target 10 using the aiming device 350. The calculation device 320 controls the attack device 360 to perform the attack against the acquired relative position. For example, in a case where the attack device 360 performs irradiation with the laser beam 60, the calculation device 320 controls the attack device 360 to irradiate the countermeasure position of the target 10 with the laser beam 60.

In a case where the calculation device 320 confirms a stoppage of the function of the target 10, for example, a fall of the target 10, via the aiming device 350, the calculation device 320 acquires the target information related to the target 10 to be subsequently subjected to the countermeasure from the countermeasure signal. Accordingly, the calculation device 320 sequentially performs the countermeasure against the plurality of targets 10. In a case where the countermeasure against all of the targets 10 is finished, the calculation device 320 waits until the countermeasure signal is subsequently received.

As described above, by determining the countermeasure position of the target 10 via the calculation device 220 of the allocation device 200, the countermeasure device 300 performs the countermeasure against the target 10 so that the function of the target 10 having a high threat level can be completely stopped. In addition, in a case where the target period in which the countermeasure can be performed against the target 10 is short, the calculation device 220 can determine the countermeasure position so that the countermeasure can be performed against the target 10 having a low threat level in a short time. Accordingly, the countermeasure device 300 can efficiently perform the countermeasure against the target 10.

Modification Example

The embodiments and modification examples described above are merely an example and may be changed without impeding their functions. For example, in step S130 illustrated in FIG. 6, the calculation device 220 of the allocation device 200 may determine the countermeasure position of the target 10 using any method so that the countermeasure device 300 can perform the countermeasure against each target 10 within the target period of each target 10.

In addition, the calculation device 220 may determine the countermeasure position of the target 10 based on an expected damage value to be inflicted on the protection target from the target 10. For example, the threat data 410 stores a damage probability indicating a probability that the threat target inflicts damage on the protection target. For example, in a case where the threat target ejects a bullet, the damage probability indicates a probability that the bullet hits the protection target. In addition, the damage probability includes, for example, a first damage probability, a second damage probability, and a third damage probability. The first damage probability indicates a probability that the threat target of which the function is temporarily impeded recovers the function or complements the stopped function and inflicts damage on the protection target. The second damage probability indicates a probability that the threat target of which the function is completely stopped inflicts damage on the protection target. For example, the second damage probability indicates "0" because the function is completely stopped. The third damage probability indicates a probability that the threat target not subjected to the countermeasure inflicts damage on the protection target. For example, the third damage probability indicates "1". The calculation device 220 calculates the expected damage value to be inflicted on the protection target from all of the targets 10 based on the damage probability and the destruction capability stored in the threat data 410. For example, the expected damage value is calculated as a total of the expected damage values of each target 10 calculated by adding up the destruction capability and the damage probability for each target 10. In a case where the function of the target 10 is at least temporarily impeded, the expected damage value of the corresponding target 10 is calculated by adding up the destruction capability and the first damage probability. In a case where the function of the target 10 is completely stopped, the expected damage value of the corresponding target 10 is calculated by adding up the destruction capability and the second damage probability. In a case where the countermeasure is not performed against the target 10, the expected damage value of the corresponding target 10 is calculated by adding up the destruction capability and the third damage probability. The calculation device 220 determines the countermeasure position of each target 10 such that the expected damage value is minimized. The calculation device 220 may determine the countermeasure position of each target 10 which minimizes the expected damage value using an approximation scheme for the purpose of reducing a calculation amount. For example, the calculation device 220 determines the expected damage value using a genetic algorithm or an annealing method.

The threat countermeasure system 1000 illustrated in FIG. 1 may include a plurality of the countermeasure devices 300. In this case, the calculation device 220 of the allocation device 200 determines the countermeasure position of the target 10 and the countermeasure device 300 to perform the countermeasure against the target 10 in step S130 illustrated in FIG. 6. The calculation device 220 allocates the target 10 to be subjected to the countermeasure to the countermeasure device 300 in accordance with a distance in which the countermeasure device 300 can perform the countermeasure. The countermeasure device 300 performs the countermeasure against the allocated target 10.

The threat countermeasure system 1000 may include a plurality of the detection devices 100. In this case, the calculation device 220 of the allocation device 200 may execute the processing illustrated in FIG. 6 in a case where the calculation device 220 receives the detection information from one of the plurality of detection devices 100.

In addition, the calculation device 220 of the allocation device 200 may update the countermeasure position of the target 10 in a case where the calculation device 220 receives the detection information from the detection device 100 after outputting the countermeasure signal to the countermeasure device 300. For example, the calculation device 220 determines the countermeasure positions for performing the attack against all of the targets 10 including the target 10 for which the countermeasure is not completed, based on the detection information indicating the target 10 for which the countermeasure is not completed and on the detection information newly received from the detection device 100.

The configurations described in each embodiment and modification example may be changed in any manner and/or may be combined in any manner without impeding their functions. For example, the detection device 100 illustrated in FIG. 1 may be incorporated into the allocation device 200. In this case, the communication device 210 of the allocation device 200 may acquire the detection information from the sensor 130 of the detection device 100 and transfer the detection information to the calculation device 220. The detection device 100 may be incorporated into the countermeasure device 300. In addition, the allocation device 200 may be incorporated into the countermeasure device 300. In this case, the communication device 210 of the allocation device 200 may output the countermeasure signal to the aiming device 350 and the attack device 360 of the countermeasure device 300.

In addition, the calculation device 220 of the allocation device 200 may perform a part or all of the processing performed by the calculation device 120 of the detection device 100. In addition, the calculation device 320 of the countermeasure device 300 may perform a part or all of the processing performed by the calculation device 220 of the allocation device 200. The detection program 400 and the countermeasure program 430 may be included in the threat countermeasure program 420. Each of the calculation device 120, the calculation device 220, and the calculation device 320 may be implemented by a plurality of central processing units.

In addition, the threat countermeasure system 1000 may not include the detection device 100. In this case, the detection information of the target 10 is acquired from another system. In addition, the threat countermeasure system 1000 may not include the countermeasure device 300. In this case, the threat countermeasure system 1000 transmits information indicating the countermeasure position of the target 10 to another system that can perform the countermeasure against the target 10. In addition, the countermeasure device 300 may perform the countermeasure against the target 10 using an object other than the laser beam, for example, a shell.

In addition, the calculation device 220 of the allocation device 200 may perform the countermeasure against the target 10 without receiving the countermeasure permission information indicating that the countermeasure against the countermeasure position is permitted. In this case, the calculation device 220 may omit the processing of step S140 and the processing of step S150 illustrated in FIG. 6. In a case where the calculation device 220 determines the countermeasure position of each target 10 in step S130, the calculation device 220 outputs the countermeasure information indicating the target 10 and the countermeasure position of the target 10 to the countermeasure device 300 in step S160.

For example, the threat countermeasure system and the threat countermeasure program according to each embodiment are perceived as follows.

A threat countermeasure system according to a first aspect includes a calculation device (220) and a communication device (210). The calculation device (220) determines a countermeasure position for performing attack against at least one target (10) based on a threat level of the target (10). The countermeasure position indicates any one of a first countermeasure position at which a function of the target (10) is temporarily impeded by performing the attack and a second countermeasure position at which the function of the target (10) is stopped by performing the attack.

A threat countermeasure system according to a second aspect is the threat countermeasure system according to the first aspect, in which a first countermeasure period for performing the attack against the first countermeasure position for at least temporarily impeding the function of the target (10) is configured to be shorter than a second countermeasure period for performing the attack against the second countermeasure position for stopping the function of the target (10).

By determining whether to temporarily impede the function of the target (10) or stop the function of the target (10) in accordance with the threat level, a countermeasure device (300) can efficiently perform a countermeasure against a plurality of the targets (10).

A threat countermeasure system according to a third aspect is the threat countermeasure system according to the first aspect, in which the calculation device (220) is configured to determine a target period required until each of a plurality of the targets (10) reaches a position at which a protection target can be attacked. In addition, the calculation device (220) is configured to determine the second countermeasure position as the countermeasure position for all of the plurality of targets (10) in a case where the second countermeasure period can be allocated for all of the plurality of targets (10) within each target period.

Accordingly, the countermeasure device (300) can stop the functions of all of the targets (10).

A threat countermeasure system according to a fourth aspect is the threat countermeasure system according to the first aspect, in which the calculation device (220) is configured to determine the first countermeasure position as the countermeasure position for a first target group including a part of a plurality of the targets (10) in a case where the second countermeasure period cannot be allocated for all of the plurality of targets (10) within target periods. In addition, the calculation device (220) is configured to determine the second countermeasure position as the countermeasure position for a second target group including a part of the plurality of targets (10) different from the first target group.

Accordingly, the countermeasure device (300) can perform the countermeasure against all of the targets (10) within the target periods by attacking the first countermeasure position to which the countermeasure can be performed in a short period for a part of the plurality of targets (10). In addition, the countermeasure device (300) can stop the function of a part of the targets (10).

A threat countermeasure system according to a fifth aspect is the threat countermeasure system according to the fourth aspect, in which a threat level of the target (10) included in the first target group is configured to be lower than a threat level of the target (10) included in the second target group.

Accordingly, the countermeasure device (300) can stop the function of the target (10) having a high threat level within the target period.

A threat countermeasure system according to a sixth aspect is the threat countermeasure system according to the first aspect, in which the calculation device (220) is configured to calculate an expected damage value and determine the countermeasure position based on the expected damage value.

Accordingly, the countermeasure device (300) can perform the countermeasure against the target (10) such that damage to the protection target is minimized.

A threat countermeasure system according to a seventh aspect is the threat countermeasure system according to the sixth aspect, in which different values of a damage probability are configured to be used for the target (10) subjected to a countermeasure at the first countermeasure position that is a vulnerable portion, the target (10) subjected to a countermeasure at the second countermeasure position other than the vulnerable portion, and a target (10) not subjected to a countermeasure.

Accordingly, the calculation device (220) can determine the countermeasure position of the target (10) based on damage corresponding to the countermeasure against the target (10).

A recording medium according to an eighth aspect stores a threat countermeasure program. The threat countermeasure program causes a calculation device (220) to execute determining a countermeasure position for performing attack against a target (10) based on a threat level of the target (10), and generating countermeasure information indicating that the attack is to be performed against the countermeasure position.

By determining whether to temporarily impede the function of the target (10) or stop the function of the target (10) in accordance with the threat level, a countermeasure device (300) can efficiently perform a countermeasure against a plurality of the targets (10).

The invention claimed is:

1. A threat countermeasure system comprising:

a calculation device configured to determine a countermeasure position, which is a position on a target, for performing an attack by a countermeasure device against the target based on a threat level of the target; and a communication device configured to output, to the countermeasure device, a countermeasure signal indicating that the attack is to be performed by the countermeasure device against the countermeasure position, wherein the countermeasure position indicates any one of:

a first countermeasure position, which is a position on the target, at which a function of the target is at least temporarily impeded by performing the attack; and a second countermeasure position, which is a position on the target, at which the function of the target is stopped by performing the attack.

2. The threat countermeasure system according to claim 1, wherein a first countermeasure period for performing the attack against the first countermeasure position for at least temporarily impeding the function of the target is shorter than a second countermeasure period for performing the attack against the second countermeasure position for stopping the function of the target.

3. The threat countermeasure system according to claim 1, wherein the calculation device is further configured to:

for each of a plurality of the targets, determine a target period required until a respective one of the plurality of the targets reaches a respective position at which a protection target can be attacked; and in a case where a second countermeasure period for performing the attack against the second countermeasure position for stopping the function of the target can be allocated for each of the plurality of the targets within the target period of each of the plurality of the targets, determine the second countermeasure position as the countermeasure position for each of the plurality of the targets.

4. The threat countermeasure system according to claim 1, wherein the calculation device is further configured to:

for each of a plurality of the targets, determine a target period required until a respective one of the plurality of the targets reaches a respective position at which a protection target can be attacked; and in a case where a second countermeasure period for performing the attack against the second countermeasure position for stopping the function of the target cannot be allocated for each of the plurality of the targets within the target period of each of the plurality of the targets: (i) determine the first countermeasure position as the countermeasure position for each of first targets of the plurality the targets; and (ii) determine the second countermeasure position as the countermeasure position for each of second targets of the plurality of the targets different from the first targets.

5. The threat countermeasure system according to claim 4, wherein the threat level of the target included in the group targets is lower than the threat level of the target included in the second targets.

6. The threat countermeasure system according to claim 1, wherein the calculation device is further configured to:

calculate an expected damage value based on: (i) a magnitude of damage inflicted on a protection target from a plurality of the targets; and (ii) a damage probability that the plurality of the targets inflicts damage on the protection target; and a determine the countermeasure position for performing the attack against the plurality of the targets based on the expected damage value.

7. The threat countermeasure system according to claim 6, wherein the damage probability includes:

a first damage probability that the target subjected to the attack at the first countermeasure position inflicts damage on the protection target;

a second damage probability that the target subjected to the attack at the second countermeasure position inflicts damage on the protection target; and a third damage probability that the target not subjected to the attack inflicts damage on the protection target.

8. A non-transitory storage medium storing a threat countermeasure program causing a threat countermeasure system to execute:

determining a countermeasure position, which is a position on a target, for performing an attack by a countermeasure device against the target based on a threat level of the target;

generating countermeasure information indicating that the attack is to be performed by the countermeasure device against the countermeasure position; and outputting the countermeasure information to the countermeasure device, wherein the countermeasure position indicates any one of:

a first countermeasure position, which is a position on the target, at which a function of the target is at least temporarily impeded by performing the attack; and a second countermeasure position, which is a position on the target, at which the function of the target is stopped by performing the attack.

* * * * *